United States Patent [19]

Finke et al.

[11] Patent Number: 4,804,934

[45] Date of Patent: Feb. 14, 1989

[54] ADJUSTMENT MEMBER FOR PERFORMING A MECHANICAL ROTATIONAL MOVEMENT

[75] Inventors: Klaus Finke, Bad Toelz; Klaus Baumgarten, Eglharting, both of Fed. Rep. of Germany

[73] Assignee: Messerschmitt-Boelkow-Blohm GmbH, Munich, Fed. Rep. of Germany

[21] Appl. No.: 124,861

[22] Filed: Nov. 24, 1987

[30] Foreign Application Priority Data

Nov. 25, 1986 [DE] Fed. Rep. of Germany ..... 3640188

[51] Int. Cl.[4] ..... H01F 7/08

[52] U.S. Cl. ..... 335/229; 335/272

[58] Field of Search ..... 335/229, 230, 272

[56] References Cited

U.S. PATENT DOCUMENTS

| | | | |
|---|---|---|---|
| 3,694,782 | 9/1972 | Ray | 335/272 |
| 4,447,793 | 5/1984 | Gray | 335/272 |
| 4,596,970 | 6/1986 | Vanderlaan et al. | 335/229 |

FOREIGN PATENT DOCUMENTS

| | | | |
|---|---|---|---|
| 1283387 | 11/1968 | Fed. Rep. of Germany | 335/272 |
| 3005921 | 9/1981 | Fed. Rep. of Germany | 335/272 |
| 3315682 | 11/1983 | Fed. Rep. of Germany | 335/272 |
| 1151901 | 5/1969 | United Kingdom | 335/272 |

*Primary Examiner*—George Harris

*Attorney, Agent, or Firm*—W. G. Fasse; D. H. Kane, Jr.

[57] ABSTRACT

An electromagnetic adjustment device for performing mechanical rotational movements has two electromagnetically excitable pole pieces arranged opposite each other to form an opening partially surrounded by concave circular surfaces of the pole pieces. A rotary anchor of permanent magnetic material is rotatably supported in the opening. The anchor has two opposite circular surface sections and two opposite flat surface sections. The flat surface sections face the concave circular surfaces of the pole pieces when the rotary anchor is in a position signifying a center of its operational range. The radius of the concave circular surfaces is slightly larger than the radius of the circular surface sections of the rotary anchor forming north and south poles so that four air gaps are formed between the concave circular surfaces of the pole pieces and the circular surface sections of the rotary anchor.

1 Claim, 1 Drawing Sheet

ADJUSTMENT MEMBER FOR PERFORMING A MECHANICAL ROTATIONAL MOVEMENT

FIELD OF THE INVENTION

The invention relates to an electromagnetic adjustment member for performing a mechanical rotational movement with the aid of a permanent magnetic anchor mounted for rotation between two pole pieces facing each other and energizable by electromagnetic means.

DESCRIPTION OF THE PRIOR ART

Electromagnetically operated adjustment members or devices are needed for many purposes. For example, a laser beam deflection may be accomplished by such adjustment members. Infrared target seeking devices require such adjustment members for opening and closing mechanical or electrical contacts. Such devices are also suitable for controlling throughflow quantities. Such a device is further suitable as a scanning member for infrared sight systems in helicopters. For all of these purposes it is necessary that the adjustment device is simply and easily controllable over an angular range that is as large as possible for the intended purpose. Stated differently, such adjustment devices must be capable of making mechanical rotational movements which have a high dynamic response characteristic, that is, a high accuracy within an angular range of about 50° to 70°.

German Patent Publication (DE-OS) No. 3,315,682 discloses an angular adjustment device having a first element which is magnetized to have opposite magnetic polarities and cooperating with a second element which comprises three magnetic pole components which are spaced from one another by a predetermined angular spacing. The first and second elements are rotatable relative to one another if the magnetic pole components are suitably magnetized. Two of the magnetic pole components are magnetizable in different ways so that they form a south pole on the one hand and a north pole on the other hand while the third magnetic component is magnetizable to always have the same magnetic polarity. Such a device as disclosed in German Patent Publication No. 3,315,682 is particularly suitable as a microwave switch. Stated differently, such a microwave switch moves a microwave coupling arrangement between two discrete positions in which a respective path for microwave energy is coupled into an operative position.

German Patent Publication (DE-OS) No. 3,005,921 discloses a monostable rotary anchor system for use in connection with electromagnetic drives. Such monostable rotary anchor system comprises an anchor which is rotatably mounted between two electromagnetically energizable poles to form a rotary anchor which is made of magnetically soft material, but has inserted therein at least one permanent magnet in such a way that a permanent magnetic pole is located directly next to a magnetically soft pole of the rotary anchor.

OBJECTS OF THE INVENTION

In view of the foregoing it is the aim of the invention to achieve the following objects singly or in combination:

to provide an electromagnetic adjustment member or device for performing precise mechanical rotational movements, especially in an angular range of 50° to 70°;

the electromagnetic adjustment member must be easily and simply controllable and it must have a precise response characteristic or high dynamic within its entire angular range;

to construct a control member of the type mentioned which is especially simple in its construction and has a small weight;

the control characteristic must be constant throughout the angular range; and reset springs and other mechanical reset means must be avoided.

SUMMARY OF THE INVENTION

According to the invention the adjustment member is characterized in that the rotary anchor made of permanent magnet material in the form of an elongated rod having two rounded opposite sides and two flat opposite sides is mounted for rotation in circular opening formed between two pole pieces, each having the shape of a concave circular segment, whereby the radius of the two circular segments is somewhat larger than the radius of the north and south poles of the rotary anchor, which poles are formed at the rounded sides of the anchor. The flattened sides of the rotary anchor face the circular pole pieces when the anchor is taking up a center position within its working range. The mentioned opening is formed by respectively spacing the circular pole pieces from each other by the respective spacing.

It is advantageous to make the rotary anchor of a material including rare earth metals, for example a cobalt samarium (Co—Sm) alloy, whereby the anchor is connected with a shaft at both of its ends or at one end only, said shaft or shafts extending in an axial direction.

The adjustment device according to the invention achieves the advantage that the moving anchor always faces a constant crosssectional area of the air gap throughout the entire useful angular range of its rotation. Further, four air gaps with a constant cross-sectional area are formed and all four of these air gaps are fully utilized regardless whether the anchor rotates clockwise or counterclockwise so that a constant specific torque moment is achieved throughout the entire angular working range. The magnetic basic moment changes in accordance with a linear characteristic as a function of the deflection angle so that the advantage of a constant control characteristic is assured throughout the entire useful angular range. Moreover, the present control or adjustment device has a higher efficiency than prior art devices due to the full utilization of the four available air gaps.

The device according to the invention does not require a mechanically effective reset spring for the rotary anchor. Therefore, there is also no resonance characteristic. In other words, the present device does not have a resonance frequency so that many angle versus time characteristics may be realized by the dynamic features of the present device while simultaneously providing a simpler mechanical construction because, for example, it is no longer necessary to have a hollow shaft with a torsional reset spring. This feature has the further advantage that one anchor end or both anchor ends may be easily used as shafts.

By making the rotary anchor of rare earth metal alloys, the anchor has a high acceleration capability because the magnet is not demagnetized when acceleration peaks occur, that is, when high currents are applied, so that it becomes possible to employ even very high frequencies.

The adjustment member or device according to the invention is especially suitable for driving an altitude scanner for the vertical deflection of the sensor beam in a heat imaging device such as is used, for example, in night sight devices requiring a deflection motion as can be brought about by the present adjustment member. The deflection motion is actually a composite motion resulting from the superposition of the actual scanning motion which is a saw-tooth motion with a follow-up motion which is a low frequency motion, whereby the deflection in both instances is proportional to a given adjustment instruction signal.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
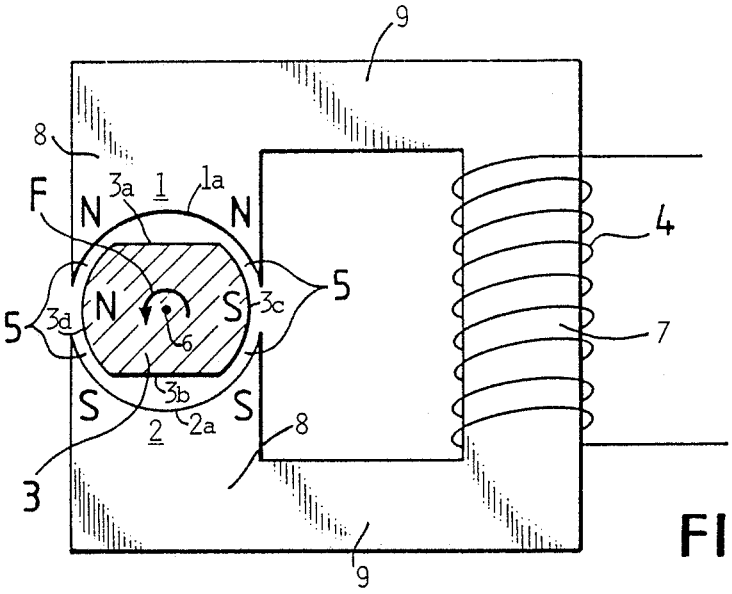
FIG. 1 is a side view of the adjustment device according to the invention with the rotary anchor shown in section, whereby one magnetic polarity orientation is illustrated.
Figure 2:
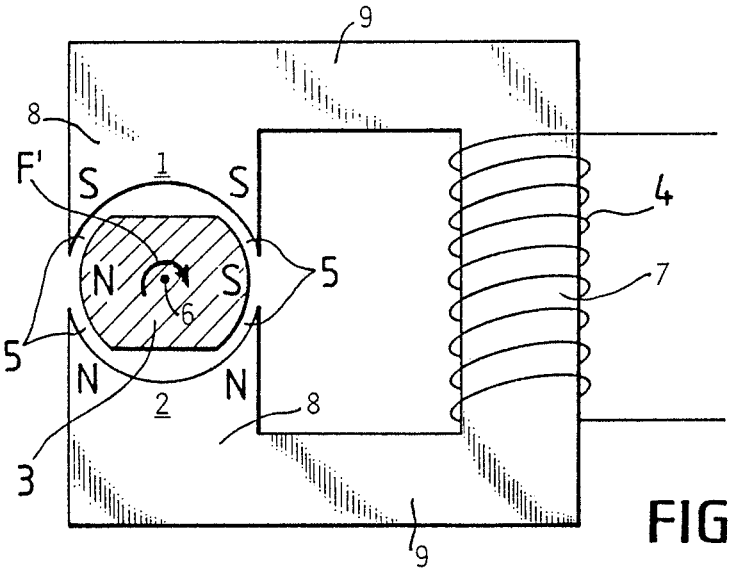
FIG. 2 is a view similar to that of FIG. 1, but illustrating another magnetic polarity orientation.

Referring to FIGS. 1 and 2, a magnetic core with a first leg 7 and a second leg 8 interconnected by cross-pieces 9 has two magnetic pole pieces 1 and 2 in the second leg 8 for forming a magnetic energizing circuit. The pole pieces 1 and 2 have a circular surface 1*a* and 2*a* respectively which is formed by cutting out a circular segment from the second leg 8 to form a cut-out. The magnetic circuit is energized by a coil 4 wound on the first leg 7. The concave circular pole piece surfaces 1*a* and 2*a* are spaced from each other to form a substantially circular gap in which a rotary anchor 3 is mounted for rotation by conventional means not shown. The anchor 3 is formed of an initially circular rod which has two flattened surfaces 3*a* and 3*b* opposite each other and two circular surface sections 3*c* and 3*d* also opposite each other. The rounded or circular surface 3*c* forms the south pole and the circular surface 3*d* forms the north pole of the rotary anchor 3 in the polarization pattern shown in FIG. 1. A shaft is symbolically shown at 6 and may extend from one or both ends of the rotary anchor 3. This shaft or shafts 6 extend axially out of the anchor and may, for example, be connected to a deflecting mirror or the like. As shown in both FIGS. 1 and 2 the rotational axis of the anchor 3 extends in a plane which itself extends at a right angle to the longitudinal axis of the coil 4.

The radius of the two surfaces 1*a* and 2*a* forming the anchor facing surfaces of the respective pole pieces 1 and 2, are slightly larger than the radius of the rounded surfaces 3*c* and 3*d* of the rotary anchor 3. Thus, a total of four air gaps 5 are formed between the pointed tips of the pole pieces 1 and 2 and the anchor 3.

In FIG. 1 the current flow direction in the energizing electrical coil 4 is so selected that the pole piece 1 forms the north pole and the pole piece 2 forms the south pole. Thus, the anchor 3 rotates counterclockwise as indicated by the arrow F. In FIG. 2 the current flow direction in the coil 4 is opposite to that in FIG. 1 so that the pole piece 1 forms the south pole and the pole piece 2 forms the north pole, whereby the anchor 3 rotates clockwise as indicated by the arrow F'. In both instances, the angular acceleration of the anchor 3 is a function of the strength of the current in the coil 4.

Within the given angular rotational range, that is, an angular range of about up to 70° or about 35° in either direction out of a zero position of the anchor 3, between the two maximum positions, the cross-sectional area of the air gaps 5 remains constant. By fully utilizing the four available air gaps when the anchor 3 is rotating in one or the other direction, the apparatus of the invention achieves a constant specific torque moment throughout the entire angular range, whereby the basic magnetic moment varies linearly with the deflection angle of about 35° out of said zero position. As mentioned, the rotary anchor 3 is preferably made of an alloy of rare earth metals such as cobalt and samarium so that very high frequencies for the rotational displacement of the anchor 3 may be used.

It will be appreciated from an inspection of FIGS. 1 and 2 that the present electromagnetic adjustment device has an especially simple construction, making it particularly suitable for example, in an infrared sighting device for night flying equipment in helicopters. Another advantage of the present simple construction is a space and cost saving amounting to about 60 to 70% as compared to the space and cost requirements of comparable conventional adjustment members. The present device has an especially high dynamic, that is, an especially accurate response characteristic through a relatively large angular range. Additionally, the reproducibility of the mechanical angular motions throughout the angular range is especially good without the need of a torsion reset spring.

Although the invention has been described with reference to specific example embodiments, it will be appreciated, that it is intended to cover all modifications and equivalents within the scope of the appended claims.

What we claim is:

1. An electromagnetic adjustment device for causing limited mechanical rotational movements in either direction out of a zero position, comprising a magnetic core having a first leg and a second leg interconnected for forming a magnetic circuit, and electrical coil on said first core leg for generating a magnetic flux in said magnetic circuit, a substantially circular cut-out in said second leg for forming two poles pieces (1, 2) each having a concave circular pole piece surface (1*a*, 2*a*) facing each other across said cut-out, a permanent magnetic anchor rotatably mounted in said cut-out for forming air gaps between said anchor and said pole piece surfaces, said anchor comprising a rod having two circular surface sections located opposite each other and forming a north pole and a south pole, and two flat surface sections opposite each other, said anchor having a rotational axis extending in a plane which itself extends at 90° to a longitudinal axis of said electrical coil, a shaft extending coaxially from a least one end of said anchor, said circular surface sections of said anchor and said circular concave pole piece surfaces having such radial dimensions that four equal air gaps (5) are formed when said anchor is in a zero position, and so that the cross-sectional area of said four air gaps remains constant when said anchor is rotated out of said zero position for about 35° in either direction, whereby the specific torque moment of the device remains constant throughout the entire effective range of about 70° of said device.

* * * * *